US005800957A

United States Patent [19]

Agata et al.

[11] Patent Number: 5,800,957

[45] Date of Patent: *Sep. 1, 1998

[54] TONER FOR ELECTROSTATIC LATENT IMAGE DEVELOPMENT AND PROCESS FOR PRODUCING THE SAME

[75] Inventors: Takeshi Agata; Takashi Imai, both of Ashigara, Japan

[73] Assignee: Fuji Xerox Co., Ltd., Tokyo, Japan

[ * ] Notice: The term of this patent shall not extend beyond the expiration date of Pat. No. 5,510,219.

[21] Appl. No.: 509,853

[22] Filed: Aug. 1, 1995

[30] Foreign Application Priority Data

Aug. 9, 1994 [JP] Japan ..... 6-187144

[51] Int. Cl.[6] ..... G03G 9/093; G03G 9/087

[52] U.S. Cl. ..... 430/109; 430/106; 430/110; 430/137

[58] Field of Search ..... 430/106, 137, 430/110, 109, 138

[56] References Cited

U.S. PATENT DOCUMENTS

| | | | |
|---|---|---|---|
| 4,708,924 | 11/1987 | Nagai et al. | 430/138 |
| 5,118,590 | 6/1992 | Kakimi | 430/138 |
| 5,166,032 | 11/1992 | Nakamura et al. | 430/137 |
| 5,399,454 | 3/1995 | Imai et al. | 430/109 |
| 5,441,840 | 8/1995 | Imai et al. | 430/109 |
| 5,510,219 | 4/1996 | Agata et al. | 430/106 |

FOREIGN PATENT DOCUMENTS

| | | |
|---|---|---|
| A-53-17737 | 2/1978 | Japan . |
| A-58-7648 | 1/1983 | Japan . |
| 63-158567 | 7/1988 | Japan . |

OTHER PUBLICATIONS

Patent & Trademark Office English–Language Translation Of JP 63–158567 (Pub. 7/88).

Caplus Abstract AN1989;48371 of JP 63–158567 (Pub. 7/88).

Japio Abstract AN 88–158567 of JP 63–15867 (Pub. 7/88).

*Primary Examiner*—Janis L. Dote

*Attorney, Agent, or Firm*—Oliff & Berridge, PLC

[57] ABSTRACT

A toner for electrostatic latent image development composed of a core substance containing a colorant and a binder resin and an outer shell, in which the colorant in the core substance is treated with an amino-containing coupling agent and a rosin derivative.

10 Claims, No Drawings

TONER FOR ELECTROSTATIC LATENT IMAGE DEVELOPMENT AND PROCESS FOR PRODUCING THE SAME

FIELD OF THE INVENTION

This invention relates to a toner used for development of an electrostatic latent image in electrophotography and electrostatic recording and a process for producing the same.

BACKGROUND OF THE INVENTION

A wet process for preparing toner particles usually comprises dissolving or dispersing a pigment and a binder resin in an oily phase and adding the oily mixture into an aqueous phase to form fine particles. However, in case where the pigment has poor dispersibility in the oily phase or poor compatibility with an organic solvent, the capsule toner particles formed would have poor pigment dispersion and, sometimes, the pigment comes out of the toner fine particles into the aqueous phase.

In order to solve this problem, it has been proposed to treat the surface of pigment particles so as to improve dispersibility. For example, JP-A-53-17737 and JP-A-58-7648 (the term "JP-A" as used herein means an "unexamined published Japanese patent application") disclose pigment particles having a silane coupling agent or a titanate coupling agent chemically bonded to the surface thereof, which are obtained by treating pigment particles with the coupling agent in an organic solvent followed by heat drying. However, according to the conventional surface treatment of pigments, the treated pigment should be once separated from the solvent. It tends to follow that the pigment particles undergo secondary agglomeration and are not sufficiently dispersed, sometimes breaking out of capsules. Further, such capsule toner particles exhibit deteriorated particle size distribution, which lead to deterioration of toner characteristics, such as chargeability, developing properties, preservability, and the like.

SUMMARY OF THE INVENTION

An object of the present invention is to provide a toner for electrostatic latent image development which is obtained by a wet process while preventing colorant particles from migrating from an oily phase to an aqueous phase and therefore exhibits satisfactory chargeability and developing properties, and especially narrow particle size distribution and provides a high quality image.

Another object of the present invention is to provide a process for producing such a toner.

The present inventors have made an extensive study on how to uniformly disperse a colorant in an oily medium constituting the core substance of a toner. They have found as a result that the dispersibility of a colorant can be improved by treating the colorant with an amino-containing coupling agent and a rosin derivative and thus reached the present invention. In particular, it has been ascertained that where an amino-containing coupling agent and a rosin derivative are added to an oily medium together with a colorant to prepare a satisfactory disperse system of the colorant, which is then subjected to interfacial polymerization to form an outer shell, the colorant can be prevented from migrating into the outside aqueous phase and that the resulting capsule toner has a narrow particle size distribution. The thus prepared toner exhibits satisfactory developing properties and chargeability.

The present invention provides a toner for electrostatic latent image development composed of a core substance containing a colorant and a binder resin and an outer shell, in which the colorant in the core substance is treated with an amino-containing coupling agent and a rosin derivative.

In a preferred embodiment of the toner, the amino-containing coupling agent is at least one selected from the group consisting of an aminosilane coupling agent, an aminotitanate coupling agent, and an aminoaluminum coupling agent, the amino-containing coupling agent being preferably used in an amount of 0.01 to 10% by weight based on the colorant.

In another preferred embodiment of the toner, the rosin derivative is selected from the group consisting of natural rosin, an abietic acid derivative or a metal salt thereof; a pimaric acid derivative or a metal salt thereof; and a resin-modified product thereof, the rosin derivative being preferably used in an amount of 0.01 to 50% by weight based on the colorant.

In still another preferred embodiment of the toner, the outer shell comprises at least one resin selected from the group consisting of a polyurea resin, a polyurethane resin, an epoxyurea resin, and an epoxyurethane resin.

The present invention also provides a process for producing a toner for electrostatic latent image development comprising mixing a colorant, an amino-containing coupling agent, a rosin derivative, a binder resin, and a first shell-forming monomer in an oily medium, dispersing the oily mixture in an aqueous medium to form oily droplets, and polymerizing the first shell-forming monomer and a second shell-forming monomer in the aqueous medium on the droplet interface to form an outer shell.

DETAILED DESCRIPTION OF THE INVENTION

The amino-containing coupling agent which can be used in the present invention includes an aminosilane coupling agent, an aminotitanate coupling agent, and an aminoaluminum coupling agent. Examples of suitable aminosilane coupling agents include γ-aminopropyltrimethoxysilane, γ-aminopropyltriethoxysilane, N-(β-aminoethyl)-γ-aminopropyltrimethoxysilane, γ-(diethylenetriamino) propyltrimethoxysilane, and aminobis(trimethylsilane). Examples of suitable aminotitanate coupling agents include isopropyltri(N-aminoethylaminoethyl)titanate, isopropyltri (p-aminophenyl)titanate, and diaminostearoylethylene titanate. Examples of suitable aminoaluminum coupling agents include those represented by the following structural formula:

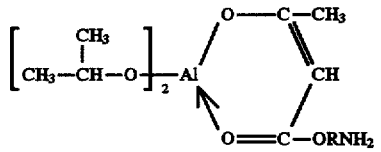

wherein R represents an alkylene group having 1 to 4 carbon atoms.

The amino-containing coupling agent is preferably used in an amount of 0.01 to 10% by weight, still preferably 0.1 to 5% by weight, based on the colorant used. If the amount of the amino-containing coupling agent is less than 0.01% by weight, the effects of the addition are hardly exerted, and the colorant tends to be dispersed in a solvent. If it exceeds 10% by weight, the colorant is apt to agglomerate.

The rosin derivative which can be used in the present invention include natural rosin (e.g., gum rosin, wood rosin, tall rosin, etc.); an abietic acid derivative or a pimaric acid derivatives or a metal salt thereof (e.g., abietic acid, neoabietic acid, palustric acid, levopimaric acid, tetrahydroabietic acid, dihydroabietic acid, dihydropalustric acid, and an alkali metal salt, an alkaline earth metal salt or an aluminum salt of these diterpene acids; and a resin-modified product thereof (e.g., rosin-maleic acid resin or rosin-phenol resin).

The rosin derivative is preferably used in an amount of 0.01 to 50% by weight, still preferably 0.1 to 30% by weight, based on the colorant used. If the amount of the rosin derivative is less than 0.01% by weight, the effects of addition are hardly exerted, and the colorant tends to be dispersed in the solvent. If it exceeds 50% by weight, the fixing strength tends to be reduced.

The binder resin to be used in the core substance can be selected from known resins for fixing. Those soluble in an organic solvent are preferred. Examples of suitable binder resins are polyester, polyamide, epoxy resins, amino resins such as polyurea and melamine resins, polyurethane, polyvinyl acetate, polyvinyl chloride, polyvinyl pyrrolidone, poly(meth)acrylates and copolymers thereof, styrene polymers, styrene-butadiene copolymers, methyl vinyl ether-maleic anhydride copolymers, coumarone-indene copolymers, and rubbers. Of these resins, polyester resins are particularly preferred for their fixing properties and color developing properties. These binder resins preferably have a weight average molecular weight of 1,000 to 300,000.

The colorant which can be used in the core substance includes dyes and pigments. Examples of suitable colorants include inorganic pigments, such as carbon black, red iron oxide, Prussian blue, and titanium oxide; azo pigments, such as Fast Yellow, Disazo Yellow, pyrazolone red, Chelate Red, Brilliant Carmine, and Para Brown; phthalocyanine pigments, such as copper phthalocyanine and metal-free phthalocyanine; and condensed polycyclic pigments, such as flavanthrone yellow, dibromoanthrone orange, perylene red, quinacridone red, and dioxazine violet. Disperse dyes and solvent dyes may also be employed.

Further, a magnetic powder may be used as the colorant in a magnetic one-component toner. Examples of suitable magnetic powders are magnetite, ferrite, and single metals, e.g., cobalt, iron, and nickel, or alloys thereof.

The colorant is preferably used in an amount of 0.1 to 10% by weight, still preferably 0.5 to 5% by weight, based on the fixing component (the binder resin used).

The outer shell of a capsule toner is formed by interfacial polymerization of a first reactant (monomer) in an oily medium and a second reactant (monomer) in an aqueous medium and is preferably comprised of at least one resin selected from polyurea, polyester, polyurethane, polyamide, etc. For interfacial polymerization, a polyisocyanate compound or a polycarboxylic acid chloride is used as a first monomer, and a hydroxy compound or a metal salt thereof or a polyamine is used as a second monomer.

The polyisocyanate compound as a first monomer includes p-phenylene diisocyanate, 2,4-tolylene diisocyanate, hexamethylene diisocyanate, methylsilyl triisocyanate and a xylylene diisocyanate, and trimethylolpropane adducts thereof.

The polycarboxylic acid chloride as a first monomer includes adipic acid dichloride, phthalic acid dichloride, and trimellitic acid chloride; however, any known polycarboxylic acid chloride may be used.

The first monomer is preferably used in an amount of 0.01 to 10% by weight, still preferably 0.05 to 5% by weight, based on the fixing component.

The hydroxy compound or a metal salt thereof as a second monomer includes ethylene glycol, 1,3-propanediol, hydroquinone and bisphenol A, and a sodium, calcium or lithium salt thereof.

The polyamine as a second monomer includes ethylenediamine, trimethylenediamine, m-phenylenediamine, and piperazine. Water may also be used.

The second monomer to be used is not limited to the above-enumerated examples, and any of other known compounds may be employed. These compounds may be used either individually or as a combination thereof.

The second monomer may be used in an amount of from 1 to 3 mol per mol of the first monomer.

The oily medium which can be used in the present invention is not particularly limited in kind as long as it is capable of dissolving the binder resin for fixing, the amino-containing coupling agent, and the rosin derivative. Examples of suitable oily medium are ethyl acetate, butyl acetate, and methylene chloride.

The toner of the present invention can be produced as follows.

In a first step, a colorant is dispersed in an oily medium to prepare an colorant dispersed solution. In this step, it is preferable to add a binder resin to the colorant dispersed solution in an amount of from 1 to 10 wt % based on the total binder resin added to the core substance, more preferably in almost the same amount of the colorant added.

In a second step, an amino-containing coupling agent and a rosin derivative are added to the colorant dispersed solution.

In a third step, a binder resin and a first shell-forming monomer are added to the processed colorant dispersed solution to form an oily mixture.

In a fourth step, the oily mixture is dispersed in an aqueous medium containing a second shell-forming monomer to form oily droplets.

In a fifth step, the first shell-forming monomer and the second shell-forming monomer are polymerized on the interface of the droplets to form an outer shell.

In a fourth step, the resulting oily mixture is added to an aqueous medium containing a shell-forming second monomer and dispersed and emulsified by a mechanical means, such as stirring, to prepare an oil-in-water emulsion of the oily mixture in the aqueous medium.

In carrying out emulsification, a protective colloid may previously be added to the aqueous medium. A water-soluble polymer appropriately selected from anionic polymers, cationic polymers, and amphoteric polymers can be used as a protective colloid. Polyvinyl alcohol, gelatin, and cellulose derivatives are preferred.

The protective colloid may be added to the aqueous medium in an amount of from 0.1 to 10 wt %, preferably 1 to 5 wt %.

Examples of the aqueous medium include water and alcohols such as ethylene glycol, propylene glycol, butane diol and glycerin. Of them, a water solution is preferred.

The aqueous medium may also contain a surface active agent appropriately selected from anionic or nonionic surface active agents which do not act on the above-described protective colloid to cause sedimentation or agglomeration. Examples of preferred surface active agents are sodium alkylsulfates (e.g., sodium laurylsulfate), sodium alkylbenzenesulfonates (e.g., sodium nonylbenzenesulfonate), sodium dioctylsulfosuccinate, and polyoxyalkylene glycol monoethers (e.g., polyoxyethylene nonyl phenyl ether).

The surface active agent may be added to aqueous medium in an amount of from 0.1 to 10 wt %, preferably from 1 to 5 wt %.

The thus prepared oil-in-water emulsion easily undergoes interfacial polymerization on the surface of the oily droplets to form an outer shell. The interfacial polymerization may be conducted in a temperature of from room temperature to 90° C. for 2 to 48 hours, preferably in a temperature of from room temperature to 60° C. for 3 to 10 hours.

The toner of the present invention may have an average particle size of from 1 to 20 μm, preferably from 3 to 10 μm. The toner of the present invention may preferably have a size distribution (GSD) of from 1.1 to 1.3.

If desired, the toner of the present invention may contain a charge control agent or a fixing assistant. Further, a fluidizing agent, such as silica, titania or alumina or a cleaning assistant or fixing assistant, such as polystyrene fine particles or polyvinylidene fluoride fine particles, may be externally added to the toner.

The toner of the present invention can be used either as a one-component developer or a two-component developer.

The present invention will now be illustrated in greater detail with reference to Examples, but it should be understood that the present invention is not construed as being limited thereto. All the parts and percents are by weight unless otherwise indicated.

EXAMPLE 1

Two parts of a linear polyester resin (weight average molecular weight: 8,000; glass transition point: 46° C.; melting point: 80° C.; acid value: 27; hydroxyl value: 34.2), 2 parts of Pigment Red 57:1 (Brilliant Carmine 6B), and 20 parts of ethyl acetate were dispersed in a sand mill to prepare a pigment dispersion. To the pigment dispersion were added 0.4 part of gum rosin and 0.5 part of N-(β-aminoethyl)-γ-aminopropyltrimethoxysilane, followed by stirring at room temperature for 1 hour. Then, 30 parts of the same polyester resin as used above was dissolved therein, and 3 parts of a trimethylolpropane (1 mol) adduct of xylylene diisocyanate (3 mol) ("Takenate D-110N", produced by Takeda Chemical Industries, Ltd.) and 0.9 part of methylsilyl triisocyanate ("Orgatics 310", produced by Matuinoto Kosho, K.K.) were dissolved therein to prepare an oily mixture.

The oily mixture was added to 120 parts of a 2% aqueous solution of carboxymethyl cellulose ("CELOGEN SBH", produced by Daiichi Yakuhin Kogyo K.K.), followed by stirring for 2 minutes to prepare an oil-in-water emulsion having an average particle size of 5.0 μm.

To the resulting emulsion was added 300 parts of water, and the system was stirred in a thermostat kept at 50° C. for 3 hours to conduct interfacial polymerization while removing ethyl acetate. The aqueous phase was removed by centrifugal separation to collect toner particles, which were then washed three times with water by dispersive washing, followed by lyophilization to obtain toner particles having a volume average particle size of 5.1 μm as measured with a Coulter counter (hereinafter the same) with such a narrow size distribution as have a GSD of 1.25, GSD standing for geometric standard deviation meaning a square root of a quotient of a 16% volume diameter divided by a 84% volume diameter. To 100 parts of the toner particles was added 1 part of hydrophobic titanium oxide ("T805", produced by Nippon Aerosil K.K.) to prepare a developer.

The resulting developer was tested on a copying machine ("A Color", manufactured by Fuji Xerox Co., Ltd.) in an environment simulating summer (35° C., 80% RH) and winter (10° C., 15% RH). As a result, no change in image density occurred with the environmental change, neither a toner cloud nor cleaning insufficiency was observed, and an extremely satisfactory image was obtained.

EXAMPLE 2

In the same manner as in Example 1, except for replacing Pigment Red 57:1 with Pigment Blue 15:3 (Phthalocyanine Blue G), toner particles having a volume average particle size of 4.6 μm and a GSD of 1.24. Hydrophobic titanium oxide was externally added to the toner particles in the same manner as in Example 1 to prepare a developer.

As a result of the same copying test as in Example 1, the developer provided a satisfactory image irrespective of the environmental change similarly to Example 1.

EXAMPLE 3

In the same manner as in Example 1, except for replacing the aminosilane coupling agent as used in Example 1 with 0.5 part of isopropyltri(N-aminoethylaminoethyl) titanate as an aminotitanate coupling agent, toner particles having a volume average particle size of 5.1 μm and a GSD of 1.26. Hydrophobic titanium oxide was externally added to the toner particles in the same manner as in Example 1 to prepare a developer.

As a result of the same copying test as in Example 1, the developer provided a satisfactory image irrespective of the environmental change similarly to Example 1.

EXAMPLE 4

In the same manner as in Example 1, except for replacing the aminosilane coupling agent as used in Example 1 with 0.5 part of acetaminopropoxyaluminum diisopropylate as an aminoaluminium coupling agent, toner particles having a volume average particle size of 4.5 μm and a GSD of 1.28. Hydrophobic titanium oxide was externally added to the toner particles in the same manner as in Example 1 to prepare a developer.

As a result of the same copying test as in Example 1, the developer provided a satisfactory image irrespective of the environmental change similarly to Example 1.

EXAMPLE 5

In the same manner as in Example 1, except for replacing gum rosin with 0.4 part of a rosin-maleic acid resin ("TESPOL 1105", produced by Hitachi Kasei Polymer K.K.), toner particles having a volume average particle size of 4.6 μm and a GSD of 1.25. Hydrophobic titanium oxide was externally added to the toner particles in the same manner as in Example 1 to prepare a developer.

As a result of the same copying test as in Example 1, the developer provided a satisfactory image irrespective of the environmental change similarly to Example 1.

EXAMPLE 6

In the same manner as in Example 1, except for replacing gum rosin with 0.4 part of abietic acid, toner particles having a volume average particle size of 5.0 μm and a GSD of 1.24. Hydrophobic titanium oxide was externally added to the toner particles in the same manner as in Example 1 to prepare a developer.

As a result of the same copying test as in Example 1, the developer provided a satisfactory image irrespective of the environmental change similarly to Example 1.

EXAMPLE 7

In the same manner as in Example 1, except for replacing gum rosin with 0.4 part of magnesium pimarate, toner particles having a volume average particle size of 4.6 μm and a GSD of 1.25. Hydrophobic titanium oxide was externally added to the toner particles in the same manner as in Example 1 to prepare a developer.

As a result of the same copying test as in Example 1, the developer provided a satisfactory image irrespective of the environmental change similarly to Example 1.

Comparative Example 1

Preparation of toner particles was attempted in the same manner as in Example 1, except that the aminosilane coupling agent and the rosin derivative were not used. As a result, toner particles were not at all formed, and no particles was collected.

Comparative Example 2

Toner particles were prepared in the same manner as in Example 2, except that the aminosilane coupling agent and the rosin derivative were not used. The resulting particles had a volume average particle size of 5.0 μm, but with the particle size distribution being as broad as having a GSD of 1.60, and caused image fog.

Comparative Example 3

Toner particles were prepared in the same manner as in Example 2, except for using no rosin derivative. The resulting particles had as broad a size distribution as having a GSD of 1.40, and the image obtained had reduced clearness.

As having been described, the colorant having been treated with an amino-containing coupling agent and a rosin derivative is prevented from being dispersed in an aqueous medium during the toner preparation, thereby making it possible to produce a toner having a narrow size distribution and exhibiting uniform chargeability and satisfactory developing properties and thus providing a high quality image.

While the invention has been described in detail and with reference to specific examples thereof, it will be apparent to one skilled in the art that various changes and modifications can be made therein without departing from the spirit and scope thereof.

What is claimed is:

1. A toner for electrostatic latent image development, which comprises a core substance containing a colorant and a binder resin and an outer shell for covering said core, wherein the colorant is treated with an aminoaluminum coupling agent and a rosin derivative selected from the group consisting of natural rosin; abietic acid; neoabietic acid; palustric acid; levopimaric acid; tetrahydroabietic acid; dihydroabietic acid; dihydropalustric acid; an alkali metal salt, an alkaline earth metal salt or an aluminum salt of said acids; rosin-maleic acid resin; and rosin-phenol resin.

2. A toner for electrostatic latent image development according to claim 1, wherein the aminoaluminum coupling agent is used in an amount of 0.01 to 10% by weight based on the colorant.

3. A toner for electrostatic latent image development according to claim 1, wherein the rosin derivative is used in an amount of 0.01 to 50% by weight based on the colorant.

4. A toner for electrostatic latent image development according to claim 1, wherein said outer shell comprises at least one resin selected from the group consisting of a polyurea resin, a polyurethane resin, an epoxyurea resin and an epoxyurethane resin.

5. A toner for electrostatic latent image development according to claim 1, wherein said aminoaluminum coupling agent is represented by the following formula:

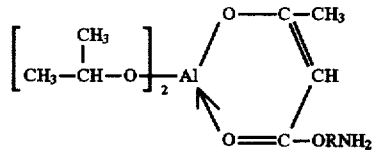

wherein R represents an alkylene group having 1 to 4 carbon atoms.

6. A process for producing a toner for electrostatic latent image development, which comprises:

mixing a colorant, an amino-containing coupling agent, a rosin derivative, a binder resin, and a first shell-forming monomer in an oily medium to form an oily mixture;

dispersing the oily mixture in an aqueous medium containing a second shell-forming monomer to form oily droplets;

emulsifying said dispersed oily mixture to form an oil-in-water emulsion; and polymerizing the first shell-forming monomer and the second shell-forming monomer on the interface of the emulsified droplets to form an outer shell;

wherein said rosin derivative is selected from the group consisting of natural rosin; abietic acid; neoabietic acid; palustric acid; levopimaric acid; tetrahydroabietic acid; dihydroabietic acid; dihydropalustric acid; an alkali metal salt, an alkaline earth metal salt or an aluminum salt of said acids; rosin-maleic acid resin; and rosin-phenol resin.

7. A process for producing a toner for electrostatic latent image development according to claim 6, wherein the amino-containing coupling agent is selected from the group consisting of an aminosilane coupling agent, an aminotitanate coupling agent and an aminoaluminum coupling agent.

8. A process for producing a toner for electrostatic latent image development, which comprises:

(A) dispersing a colorant in an oily medium to prepare a colorant dispersed solution;

(B) processing the colorant dispersed solution by adding an amino-containing coupling agent and a rosin derivative;

(C) adding a binder resin and a first shell-forming monomer to the processed colorant dispersed solution to form an oily mixture;

(D) dispersing the oily mixture in an aqueous medium containing a second shell-forming monomer to form oily droplets;

(E) emulsifying said dispersed oily mixture to form an oil-in-water emulsion; and (F) polymerizing the first shell-forming monomer and the second shell-forming monomer on the interface of the emulsified droplets to form an outer shell;

wherein said rosin derivative is selected from the group consisting of natural rosin; abietic acid; neoabietic acid; palustric acid; levopimaric acid; tetrahydroabietic acid; dihydroabietic acid; dihydropalustric acid; an alkali metal salt, an alkaline earth metal salt or an aluminum salt of said acids; rosin-maleic acid resin; and rosin-phenol resin.

9. The process for producing a toner for electrostatic latent image development according to claim 8, which further comprises dispersing a binder resin in the oily medium in step (A).

10. A process for producing a toner for electrostatic latent image development according to claim 8, wherein the amino-containing coupling agent is selected from the group consisting of an aminosilane coupling agent, an aminotitanate coupling agent and an aminoaluminum coupling agent.

* * * * *